US008294066B2

(12) United States Patent
Gill et al.

(10) Patent No.: US 8,294,066 B2
(45) Date of Patent: Oct. 23, 2012

(54) THERMALLY AND ELECTRICALLY CONDUCTIVE ELEMENT

(75) Inventors: David Keith Gill, Pinehurst, NC (US); Billy Dee Wood, Whispering Pines, NC (US)

(73) Assignee: Eaton Corporation, Cleveland, OH (US)

( * ) Notice: Subject to any disclaimer, the term of this patent is extended or adjusted under 35 U.S.C. 154(b) by 54 days.

(21) Appl. No.: 12/949,887

(22) Filed: Nov. 19, 2010

(65) Prior Publication Data

US 2012/0129623 A1 May 24, 2012

(51) Int. Cl.
*A63B 53/14* (2006.01)
*H05B 3/46* (2006.01)
*H05B 3/02* (2006.01)

(52) U.S. Cl. ..... 219/201; 219/507; 219/535; 219/544; 473/300

(58) Field of Classification Search ..... 219/201, 219/532–551, 202, 204; 135/65; 428/626
See application file for complete search history.

(56) References Cited

U.S. PATENT DOCUMENTS

| | | | |
|---|---|---|---|
| 2,835,245 | A | 5/1958 | Morgan |
| 3,292,628 | A | 12/1966 | Pearl |
| 3,694,622 | A | 9/1972 | Bentley |
| 3,742,635 | A | 7/1973 | Hutto |
| 4,471,209 | A | 9/1984 | Hollander |
| 4,825,039 | A | 4/1989 | Yoo |
| 4,937,429 | A | 6/1990 | Hollander |
| 5,062,528 | A | 11/1991 | Whitaker |
| 5,341,927 | A | 8/1994 | Coyner |
| 5,585,026 | A | 12/1996 | Smith |
| 5,655,328 | A | 8/1997 | Childs |
| 5,774,894 | A | 7/1998 | Yates |
| 5,834,734 | A | 11/1998 | Ogata |
| 5,834,738 | A | 11/1998 | Wilson |
| 5,901,615 | A | 5/1999 | Itoh |
| 6,035,442 | A | 3/2000 | Marando |
| 6,164,003 | A | 12/2000 | Miller |
| 6,247,469 | B1 | 6/2001 | Guard |

(Continued)

FOREIGN PATENT DOCUMENTS

| | | |
|---|---|---|
| DE | 19910132 | 3/2000 |

(Continued)

OTHER PUBLICATIONS

European Search Report dated Apr. 4, 2012.

*Primary Examiner* — Henry Yuen
*Assistant Examiner* — Jianying Atkisson
(74) *Attorney, Agent, or Firm* — Daniel S. Kalka

(57) ABSTRACT

A heated element includes a thermally and electrically conductive polymer in a shaped or spaced arrangement. The spaced arrangement has at least one string of material with ends that are configured to be electrically connected to a power source. A first end is connected to a positive terminal of the power source while the other end is connected to a negative terminal of the power source. A hand grip includes the heating element disposed on an inner layer, and may include an outer layer. The spaced arrangement may be disposed between the inner and outer layer for indirect heating applications. Alternatively, portions of the spaced arrangement may protrude from either the inner layer or the outer layer for direct heating applications. The heated element may be used with a number of devices, including but not limited to, golf club grips, hand grips, heating pads, blankets, or other applications.

16 Claims, 5 Drawing Sheets

U.S. PATENT DOCUMENTS

| | | | | |
|---|---|---|---|---|
| 6,275,996 | B1 | 8/2001 | Redwood | |
| 6,514,279 | B1 | 2/2003 | Lavin | |
| 6,727,467 | B1 * | 4/2004 | Hadzizukic et al. | 219/204 |
| 6,756,573 | B2 | 6/2004 | Cornell | |
| 7,091,450 | B1 | 8/2006 | Hollander | |
| 7,145,102 | B2 | 12/2006 | Hadzizukic | |
| 7,189,943 | B2 | 3/2007 | Richlen | |
| 7,214,906 | B1 | 5/2007 | Hansen | |
| 7,378,483 | B2 | 5/2008 | Wu | |
| 2002/0166407 | A1 | 11/2002 | Germuth-loffler | |
| 2003/0024343 | A1 | 2/2003 | Perezlmize | |
| 2004/0007567 | A1 | 1/2004 | Downey | |
| 2004/0050205 | A1 | 3/2004 | Putnam | |
| 2004/0220356 | A1 | 11/2004 | Wu | |
| 2005/0103769 | A1 | 5/2005 | Marquis | |
| 2005/0111177 | A1 | 5/2005 | Kwitek | |
| 2005/0268744 | A1 | 12/2005 | Embach | |
| 2006/0195968 | A1 | 9/2006 | Powell | |
| 2007/0007266 | A1 | 1/2007 | Sasaki | |
| 2007/0142756 | A1 | 6/2007 | Beiruti | |
| 2008/0034915 | A1 | 2/2008 | Bigolin | |
| 2008/0116188 | A1 | 5/2008 | Fukuda | |
| 2008/0185369 | A1 | 8/2008 | Schmauder | |
| 2008/0210048 | A1 | 9/2008 | Yoneyama | |
| 2008/0218343 | A1 * | 9/2008 | Lee et al. | 340/568.6 |
| 2008/0272103 | A1 * | 11/2008 | Farrington | 219/201 |
| 2008/0272104 | A1 | 11/2008 | Farrington | |
| 2008/0311378 | A1 * | 12/2008 | Simpson | 428/319.1 |
| 2009/0065491 | A1 | 3/2009 | Fitzgerald | |
| 2009/0194518 | A1 | 8/2009 | Fujiwara | |
| 2009/0224523 | A1 | 9/2009 | Park | |
| 2009/0242539 | A1 | 10/2009 | Wassel | |

FOREIGN PATENT DOCUMENTS

| | | |
|---|---|---|
| DE | 20003799 | 6/2000 |
| WO | WO2008/136808 | 11/2008 |
| WO | WO2010/028155 | 3/2010 |

* cited by examiner

THERMALLY AND ELECTRICALLY CONDUCTIVE ELEMENT

BACKGROUND

The present disclosure relates generally to a thermally and electrically conductive element, and, more particularly to a thermally and electrically conductive element for applications that include but are not limited to hand grips.

Hand warmers, socks, and hand grips are some of the applications that use heating elements or material on the market today. These heated materials are particularly useful for keeping a user warm in low temperature environments. While the subject disclosure finds particular utility in hand grips and specific reference will be made thereto, it should be understood that the heated material according to the present disclosure has a wide variety of applications and should not be limited only to hand grips. Hand and sports grips are often used to reduce impact shock associated with the use of shock imparting implements. Examples of such implements include golf clubs, squash rackets, and racquetball rackets, etc. Impact shock occurs when a user swings the implement and makes contact with an object e.g., a golf ball. Impact shock can be detrimental to the body, and may cause discomfort as well as joint and/or tissue injuries.

Heated grips may be useful for users who experience discomfort even in milder temperatures, such as users with arthritis. A number of heated hand grips are currently available in the market. Such grips may generate heat using embedded wires or foil, enabling an electrical current to pass therethrough and generate heat due to the circuit's resistance. The wire or foil provides a source of radiated heat to the grip surface.

These prior art wire or foil grips suffer from drawbacks. For example, these wire or foil grips can be complex to manufacture. Each piece of wire or foil must be pre-cut and physically attached to the grip. Moreover, these wire or foil grips suffer from drawbacks in that the wires may eventually break when there is sufficient fatigue. Fatigue can occur through physical displacement, such as when the wires or foil flex.

There is a need for a heated hand grip that is flexible and relatively easy to manufacture. There is further a need for a heated golf grip that is comfortable to use and reduces impact shock associated with striking instruments.

BRIEF SUMMARY

The present disclosure addresses the foregoing deficiencies of the prior art as well as others by providing a thermally and electrically conductive element that is electrically heated as a result of its electrical resistance using a power source. In accordance with one embodiment of the present disclosure, a thermally and electrically conductive heated hand grip is provided.

The thermally and electrically conductive element according to the subject disclosure comprises a power source, and a control switch configured to selectively activate and deactivate the power source. The thermally and electrically conductive element also comprises an inner layer composed of an electrically and thermally insulating material. The heated element further comprises a thermally and electrically conductive polymer material disposed in a spaced arrangement on an outer surface of the inner layer. The arrangement is configured to be electrically connected to a power source. The arrangement is configured to disperse heat when the control switch activates the power source and electricity flows through the arrangement. The heated element may further include an outer layer disposed over the inner layer.

In accordance with one embodiment of the present disclosure, a hand grip comprises a power source and a control switch configured to selectively activate and deactivate the power source. The grip also comprises a substantially cylindrical inner core composed of an electrically and thermally insulating material. The grip further comprises a thermally and electrically conductive polymer material disposed in an arrangement on an outer surface of the inner core. The arrangement is configured to be electrically connected to the power source. The arrangement is configured to disperse heat when the control switch activates the power source and electricity flows through the arrangement. The grip may include an outer layer disposed over the inner core.

These, as well as other features and benefits, will now become clear from a review of the following detailed description of illustrative embodiments and the accompanying drawings.

DETAILED DESCRIPTION

The present disclosure provides for a thermally and electrically conductive element for use in a wide variety of applications. It should be understood that the thermally and electrically conductive element (also referred to herein simply as "element" or "heating element") as described herein can be used for providing surface heating for objects ranging from flat pads or blankets to large round sleeves including but not limited to grips, gloves, socks, etc. Moreover, the heating element as described herein can be used to heat a number of different devices, including but not limited to storage tanks, seats, handle bar grips, sporting grips, gun stocks and fishing poles. While the present disclosure is described in detail in terms of a golf grip, it should be understood that the claimed invention of this disclosure is not intended to only be limited thereto.

Figure 1:
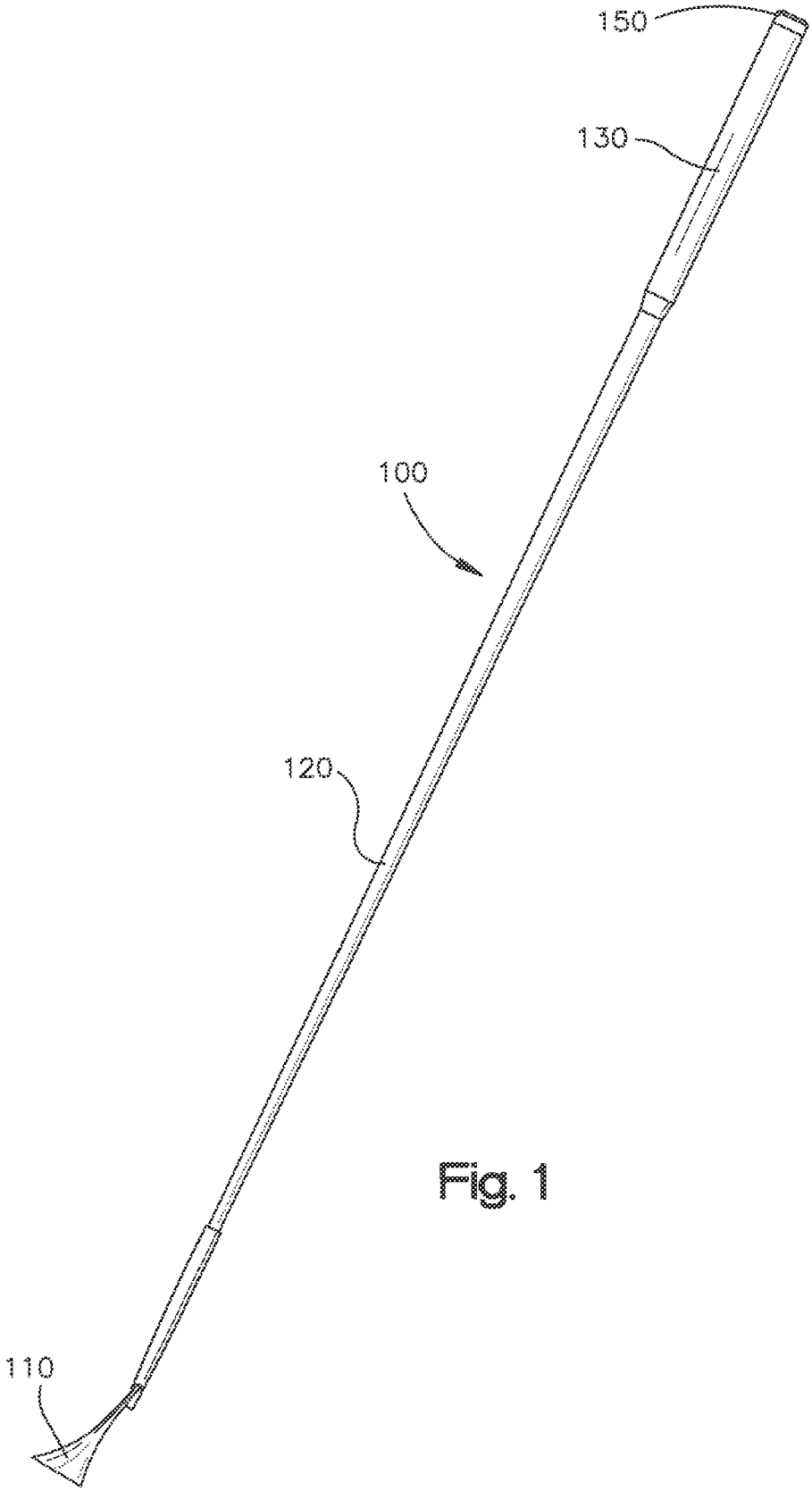
FIG. 1 is a perspective view of a golf club incorporating a thermally and electrically conductive element in a grip in accordance with one embodiment of the present disclosure.

Referring to the figures, where like numerals designate like or similar features throughout the several views, and now to FIG. 1, there is shown a golf club that includes a golf grip mounted over the proximal end of the golf club shaft. The terms proximal and distal are used herein from the perspective of the golfer. The golf club 100 includes a head 110 disposed at its distal end, and an elongated shaft 120. At the proximal end of elongated shaft 120 is the grip 130.

Although the illustrated grip 130 includes a proximal end with a larger diameter than its distal end, it should be understood that the grip 130 could take on a number of different configurations, including but not limited to, a cylindrical configuration where both the proximal end and the distal end have substantially the same diameter. One such example is a reverse taper shape. Golf grip 130 is but one example of a hand grip suitable for the heating element of the present disclosure.

Grip 130 includes an end cap 150 located at the proximal end or butt end of the elongated shaft 120. End cap 150 is a standard golf grip end cap. Grip 130 and end cap 150 may be assembled as a single unit. Alternatively, the grip and end cap may be separate units.

An electrical power source may be disposed anywhere within grip 130 or within the end cap 150. The power source may be a battery or like power source. Where a resistance generator is used, the generator could be composed of a magnet and coil, similar to those resistance generators used in watches.

Figure 2:
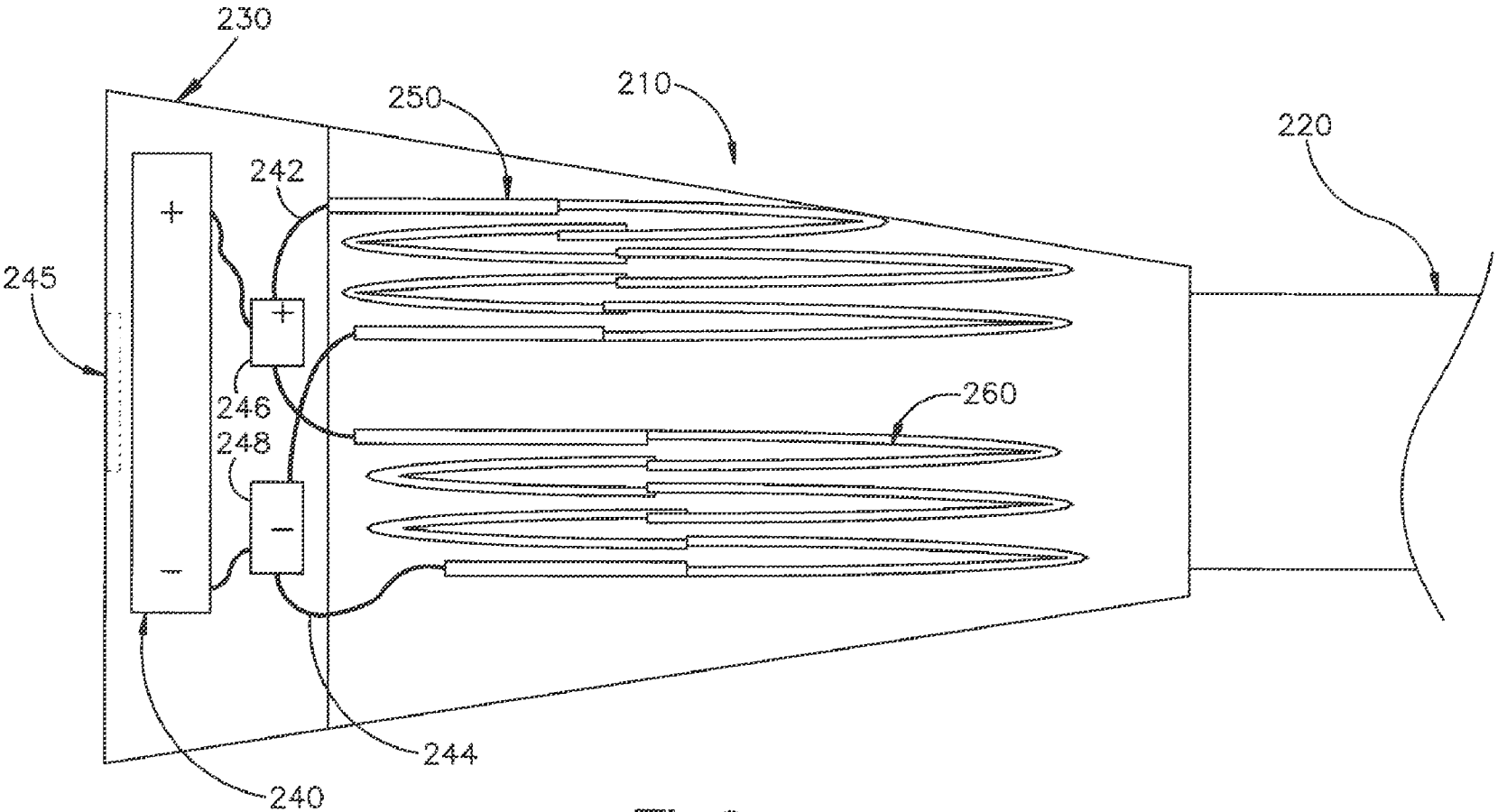
FIG. 2 is a side view of an illustrated grip depicting a thermally and electrically conductive element on the grip prior to covering the element with an outer layer in accordance with one embodiment of the present disclosure.

Referring now to FIG. 2, there is shown a sectional side view of a hand grip with the heating element in accordance with one embodiment of the present disclosure. The hand grip may be a golf grip, or a grip for another application. The grip 210 is mounted onto a shaft 220. The heating element in this embodiment comprises a shaped arrangement resembling one or more strips or strings that can have a coil shape, of thermally and electrically conductive material 250, 260 positioned on or in grip 210. The terms "strips" or "strings" or "coils" as used herein refer to discrete arrangements of an electrically and thermally conductive polymeric material such as SS-26S or SS-27 material commercially available from Silicone Solutions, 1670-C Enterprise Parkway, Twinsburg, Ohio 44087. These terms will be used interchangeably with heating element or elements.

The heating element 250, 260 on grip 210 may be composed of other material formulations as long as the material is thermally and electrically conductive. Other materials may include a thermoplastic or elastomeric polymer. The material may be molded or formed into one or more strings of material profiled in a manner that permits an end of each of the strings 250, 260 to be electrically connected to a power source 240 having a positive 242 and a negative end or terminal 244.

As shown in this configuration, the positive ends 242 of each string 250, 260 may be joined at a positive connector 246, or connected directly to the positive end 242 of power source 240. Likewise, each of the negative ends 244 of strings 250, 260 could be connected to each other by a negative connector 248 or directly to a negative end 244 of power source 240. The electrical connections may be made with any suitable electrical connector.

Power source 240 supplies electrical current to the heating elements 250, 260. This power is converted to heat through electrical resistance of the material making up the elements 250, 260. The power source 240 used with grip 210 may be low voltage. Accordingly, this should be taken into consideration when determining the degree of electrical resistance of the elements 250, 260 that can be used with the grip 210 to generate heat. The higher the resistance of the material, the greater the energy required to heat the material. The dissipated power heats the elements 250, 260 that are connected to the power source.

Although the present embodiment is described in terms of strings that can be coils, the material could be arranged in any number of configurations as long as the material can be electrically connected to a power source that provides electrical current thereto. For example, the material could be arranged into one or more straight lines that traverse the surface of grip 210 from its proximal end to its distal end, and are electrically connected to the power source 240. While the foregoing embodiment depicts two strings or elements 250, 260, one element 250 may only be employed on another embodiment. The element 250 may be positioned circumferentially around the entire grip, or strategically placed at one or more locations on the grip.

The power source 240 may be selectively activated or deactivated when the user presses the on/off button 245, or automatically activated or deactivated with a thermal sensor (not shown). In this embodiment, the on/off button 245 is disposed in the back portion of end cap 230 at its proximal end. Since the on/off button 245 is disposed in the back of the end cap 230, this reduces the chances that the user will accidentally press the on/off button 245 while handling the grip 210.

Voltage transmission capabilities of the elements 250, 260 could range from 1.5 volts up to several hundred volts depending on the string size in cross section and length as well as application requirements for heat transmission and warm up time. The fatigue life of this material may be in excess of conventional foils and wire elements. Moreover, the polymer-type grip 210 may have lower manufacturing and materials costs with higher production cycle times resulting in more efficient production processes.

In FIG. 2, the power source 240 is disposed in end cap 230. End cap 230 may be attached to grip 210 using a friction or interference fit or an adhesive, e.g., rubber cement. However, it should be understood that power source 240 could be disposed in other locations. For example, an inductive power source could be disposed in a bag that is used or associated with the grip 210 of FIG. 2, like a golf bag. The power source could also be located in the shaft 220.

Grip 210 may have more than two elements 250, 260. These multiple elements can be situated on each side of the grip or completely surrounding the grip or even at select locations on the grip.

Figure 3:
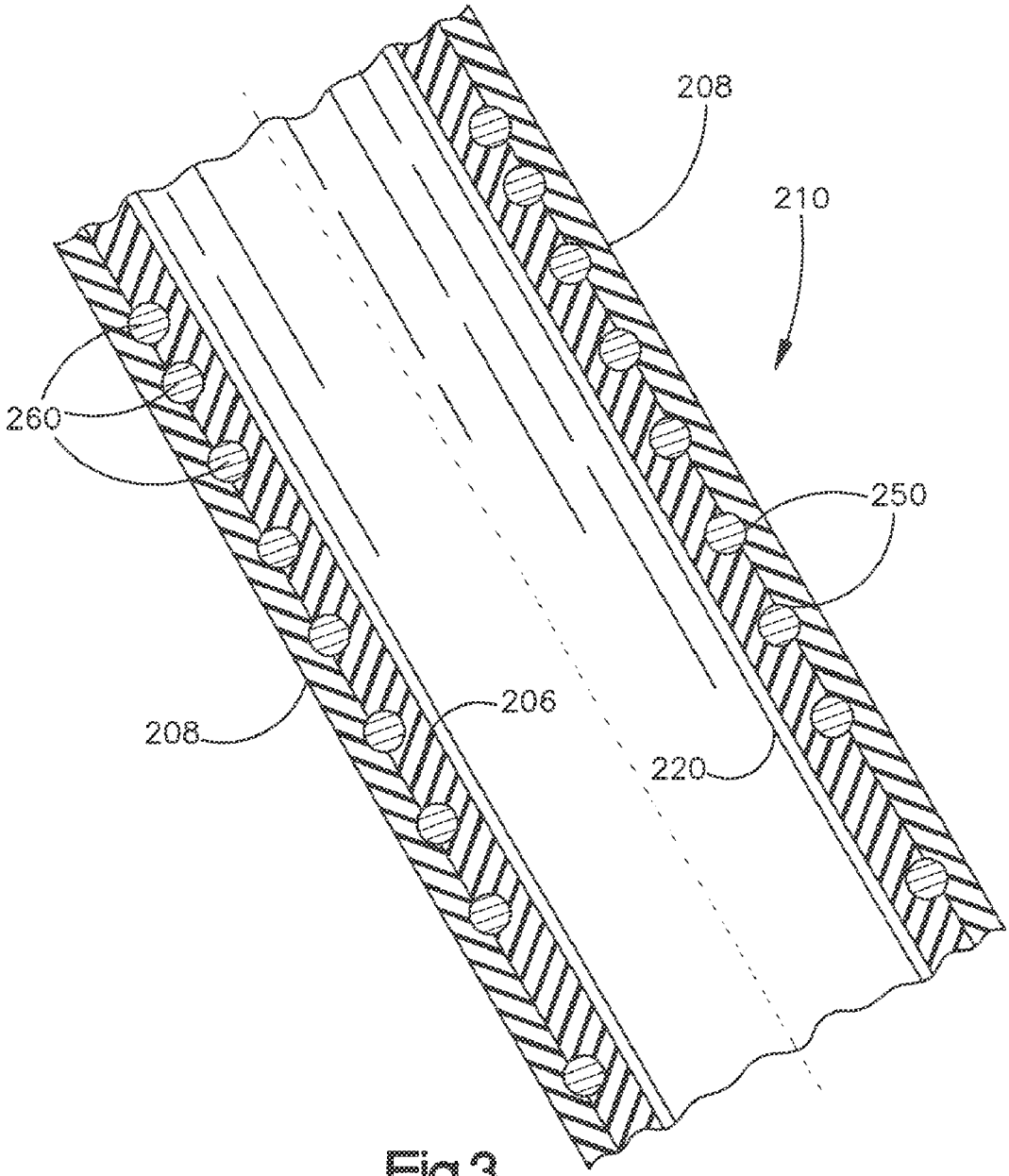
FIG. 3 is a partial longitudinal cross section view of a grip having the thermally and electrically conductive element disposed between its inner and outer layers in accordance with one embodiment of the present disclosure.

Referring next to FIG. 3, there is depicted a partial, longitudinal cross-sectional view of the grip of FIG. 2 with an outer layer 208 added in accordance with an embodiment of the present disclosure. The grip includes an inner core or layer 206. The inner core 206 can be an underlisting for a golf club grip as seen in U.S. Pat. No. 7,458,902. The inner core 206 can be designed to slide onto or wrap around golf club shaft 220. Inner core 206 is substantially cylindrical and composed of a non-electrically conductive or insulating material such as thermoplastic material, silicone, or rubber. This type of non-electrically conductive material assists in reducing the risk of short circuits when the grip is in contact with an electrically conductive shaft which in some cases may be constructed of metal.

The inner core 206 is attached to the shaft 220 by any suitable means known in the art, for example, using double-sided adhesive tape or a spray or liquid adhesive may also be used.

Disposed on the inner core 206 are strings, 250, 260. These strings may be attached to the inner core in a number of ways. For example, the strings may be attached to the inner core by squeezing a tube of the thermally and electrically conductive material and applying it to the inner core 206 in the desired or set arrangement. Alternatively, techniques such as screen printing that incorporates spray deposition of the material may be used. Another possible technique for applying the thermally and electrically conductive material to the inner core 206 is chemical bonding. For example, the silicone element material could be chemically bonded to an uncured silicone inner core without a chemical bonding agent. Also by way of example, a rubber material could be chemically bonded to other materials using a chemical bonding agent such as Chemlok®. RTM, a rubber-to-substrate adhesive, a registered trademark of and available from Lord Chemical Company of Erie, Pa. The inner core 206 may even have a grooved pattern cut into a surface portion to retain the thermally and electrically conductive material in the groove until it cures or solidifies sufficiently into the desired set arrangement.

The outer layer 208 is the grip surface under which the heated element 250, 260 resides so that the user may warm his or her hands and still have good grip feel. Outer layer 208 may be composed of any number of materials, including but not limited to silicone, rubber or a thermoplastic material, or combinations thereof. However, it should be understood that the outer layer 208 should be at least somewhat thermally conductive since heat should pass up through outer layer 208 to the user's hands. In order to further aid in the transmission of heat from the strings to outer layer 208, outer layer 208 may be a relatively thin layer as compared with inner core 206.

Figure 6:
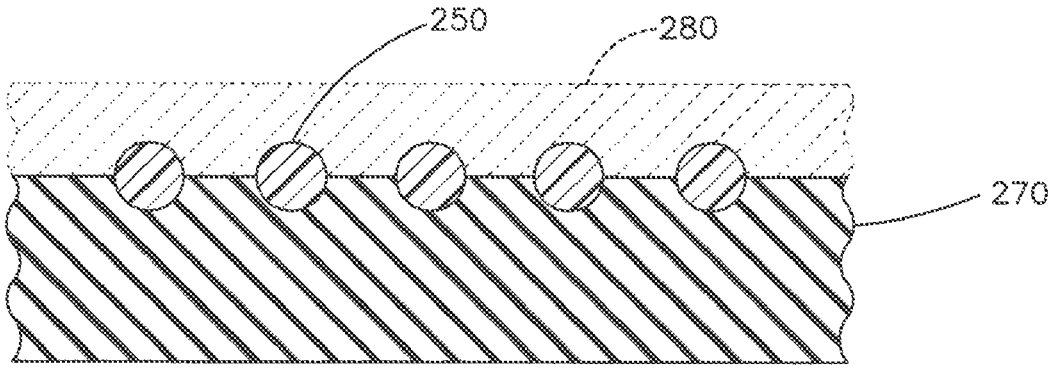
FIG. 6 is a partial cross-sectional view of the heating element in the form of a blanket.

In the present embodiment the strings are molded directly below the surface of outer layer 208. This configuration may be useful in avoiding operational damage to the heating elements 250, 260. It should also be noted that this configuration could be useful in other indirect heating applications such as for supplying a radiant heat source for tanks, pipe flasks, trays or other similar indirect heating applications in the form of a blanket or sheet comprised of an insulating inner layer 270, the heating element 250 of the subject disclosure, and an optional outer layer 280 as seen in dashed line in FIG. 6.

Figure 4:
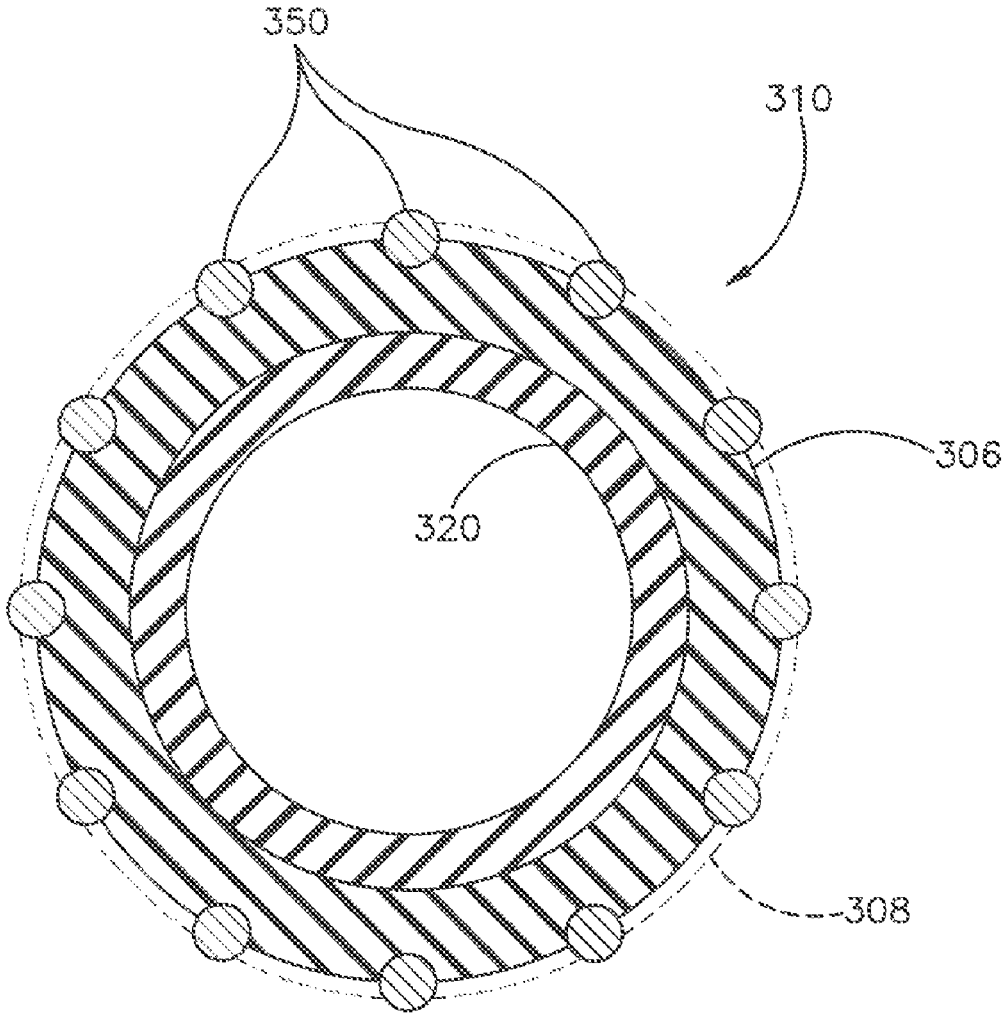
FIG. 4 is a cross section view of a grip having the thermally and electrically conductive element protruding through a layer in accordance with another embodiment of the present disclosure.

It should be further understood that the heating element could be used in direct heating applications where there is little or no outer layer between the user's hands and the heating element. Referring now to FIG. 4, there is shown in a cross-sectional view an embodiment 310 where the heating element 350 protrudes from the inner layer 306 of the grip 310 to provide a more direct path between the user's hands and the grip.

Inner core 306 is constructed to slide onto a shaft 320. Positioned in the inner core 306 is the heating element 350, which protrudes through the outer surface of the inner core 306 providing direct contact with the user so that the user may warm his or her hands. It should also be noted that in addition to keeping a user's hands warm the user may also identify the amount of pressure applied to the grip by means of measuring electrical conductivity through the strings. The protruding heating element 350 may also facilitate the grip feel and assist the user in terms of providing a firmer hold on the grip as well as providing shock absorbing qualities.

The heating element 350, may be in direct contact with the users hands because the heat is distributed across the strings, making up the element. Because the material of the heating element according to the subject disclosure doesn't have localized heat like a wire, the heating element is likely not to become as hot as wire or foil. Therefore, the user may touch the heating element directly. Unlike a wire, the material of the heating element can have a relatively large volume. Moreover, the material of the element may have a high melting point such as 400 degrees Fahrenheit. Therefore, it is designed not to melt in a temperature range suitable for a user.

An optional outer layer 308 shown in dashed fine may be included with grip 310. Various raised sections and or depressions may be formed in the heating material so that the heating material protrudes through the outer layer. While the present disclosure depicts the heating element 250, 260 in circular form, it should be understood that other shapes, such as crosses, diamonds squares, or rectangles may be used to facilitate protrusions through the outer layer 308. Other examples of raised or depressed features include, but are not limited to, ribs, dimples, knobs, or grooves.

Figure 5:
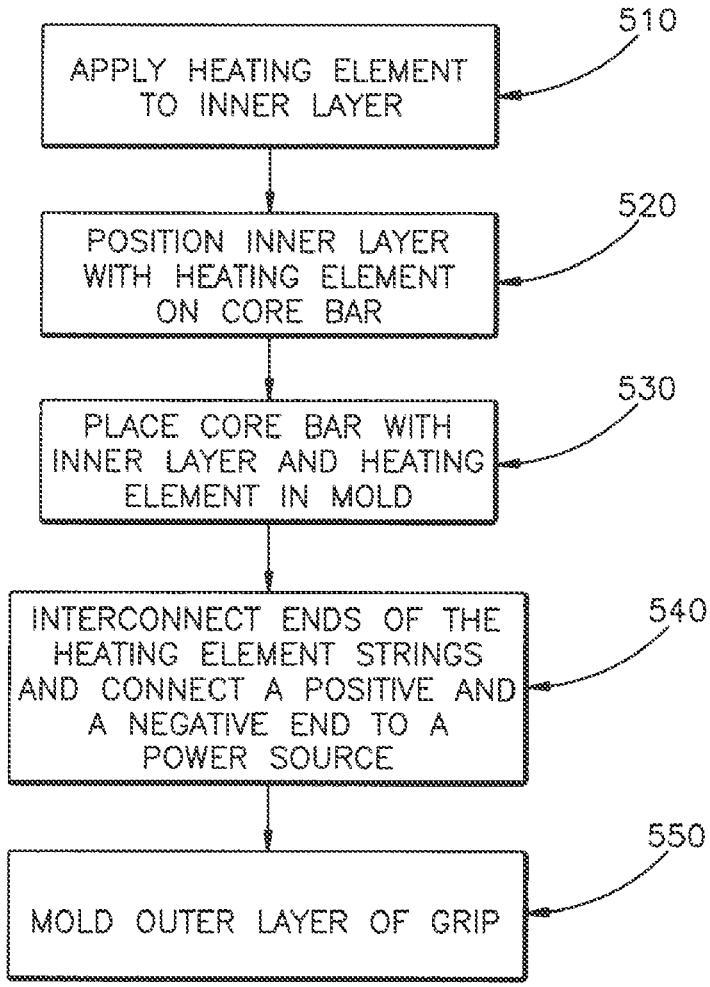
FIG. 5 is a flow diagram of a method for forming a heated hand grip having a thermally and electrically conductive element in accordance with one embodiment of the present disclosure.

Referring now to FIG. 5, there is a flow diagram providing the process steps for creating the thermally and electrically conductive grip in accordance with one embodiment of the present disclosure. Beginning with step 510 the heating element is chemically bonded or applied to an inner layer, or alternatively to an inner layer composed of a partially-cured polymeric material. For example, a conductive silicone material could be chemically bonded to an uncured nonconductive silicone inner core without a chemical bonding agent. Also by way of example, rubber could be chemically bonded to other thermally and electrically conductive materials using a chemical bonding agent such as Chemlok®. The inner layer or core can take the initial form for the grip or even be the final form depending upon the desired application.

In step 520, the inner layer with the desired arrangement of the heating element is placed onto a core bar of a compression mold. In step 530, the inner layer, heating element and core bar are inserted into a finish mold, for example a compression mold as seen in U.S. Pat. No. 7,798,912. Alternatively, the heating element, inner layer and core bar may be laid flat into a molding cavity so that it can be cured with an overmolded or outer layer composed of, for example, a polymer or elastomer like rubber or silicone that is at least somewhat thermally conductive to aid in heat transmission to the user.

In step 540, the ends of the strings of the heating element are interconnected, during the molding process or during a subsequent step, and an end connected to a positive and negative end of a suitable power source for providing electrical current through the heating element.

At step 550, an outer layer of material, such as silicone or rubber, may be molded such that the thermally and electrically conductive material, that is the strings making up the heating element, is encapsulated, in whole or part, and becomes part of the grip. The grip can be produced using liquid and/or solid injection, compression, or transfer molding techniques. The outer surface may include fabric or synthetic fibers, and be buffed or un-buffed once the grip is removed from the mold. Additions of graphical designs using molded surface textures and/or painted areas may also be included in the finished product.

For illustrative purposes only, the following examples assist in better understanding the present disclosure. A twenty-four volt (24V) power supply generates approximately one hundred and two Watts (102 W) of heat at four amperes of current (4 A) for a SS-26S material. A bead diameter of the material was approximately 0.15 centimeters (cm) with an area of approximately 0.01767 $cm^2$. The length of the bead was approximately twenty (20) cm. The resistance was approximately 5.658842 ohms and the resistivity was 0.005000 ohms-cm.

A SS-27 material with a bead diameter of approximately 0.15 cm, an area of approximately 0.01767 $cm^2$, and a length of approximately 20 cm had a resistance of approximately 11.317685 ohms. The material had a resistivity of 0.010000 ohms-cm. A 24V power supply at 2 A generates 51 W of heat.

While the specification describes particular embodiments of the present invention, those of ordinary skill can devise variations of the present invention without departing from the inventive concept.

We claim:

1. A hand grip having a thermally and electrically conductive heating element comprising:

a power source;

a control switch configured to selectively activate and deactivate the power source;

a substantially cylindrical inner core composed of an electrically and thermally insulating polymer material, the substantially cylindrical inner core being constructed to slide onto a shaft;

thermally and electrically conductive polymer coils disposed on an outer cylindrical surface of the substantially cylindrical inner core, wherein the thermally and electrically conductive polymer coils are spaced apart with at least two ends thereof; being configured to be electrically connected to the power source for providing electrical current to the thermally and electrically conductive polymer coils, the spaced apart arrangement being configured to disperse heat generated from the electrical current in the thermally and electrically conductive polymer when the control switch activates the power source; and an end cap constructed for attachment to the substantially cylindrical core, the end cap having the control switch disposed in a back portion of the end cap.

2. The hand grip of claim 1, further comprising an outer thermally conductive polymer layer disposed over at least a portion of the inner core of the electrically and thermally insulating polymer material.

3. The hand grip of claim 1, wherein the thermally and electrically conductive polymer coils is chemically bonded to the inner core.

4. The hand grip of claim 1, wherein the power source is disposed in the shaft.

5. The hand grip of claim 2, wherein the hand grip is a golf club grip.

6. The hand grip of claim 1, wherein the thermally and electrically conductive polymer coils is a member selected from the group consisting of a silicone, thermoplastic, and rubber material.

7. The hand grip of claim 2, wherein the disposed thermally and electrically conductive polymer coils includes raised portions, with some portions of the thermally and electrically conductive polymer protruding above the outer layer.

8. The hand grip of claim 1, wherein the power source is disposed in the end cap.

9. The hand grip of claim 1, wherein the substantially cylindrical inner core composed of an electrically and thermally insulating material is a member selected from the group consisting of a thermoplastic material, silicone, and rubber.

10. A hand grip having a thermally and electrically conductive heating element comprising:

a power source;

a control switch configured to selectively activate and deactivate the power source;

a substantially cylindrical inner core composed of an electrically and thermally insulating polymer material, the substantially cylindrical inner core being constructed to slide onto a shaft;

thermally and electrically conductive polymer coils embedded in the substantially cylindrical inner core, wherein the thermally and electrically conductive polymer coils are spaced apart with at least two ends thereof; being configured to be electrically connected to the power source for providing electrical current to the thermally and electrically conductive polymer coils, the spaced apart arrangement being configured to disperse heat generated from the electrical current in the thermally and electrically conductive polymer when the control switch activates the power source; and an end cap constructed for attachment to the substantially cylindrical inner core, the end cap having the control switch disposed in a back portion of the end cap.

11. The hand grip of claim 10, wherein the power source is disposed in the shaft.

12. The hand grip of claim 10, wherein the hand grip is a golf club grip.

13. The hand grip of claim 10, wherein the thermally and electrically conductive polymer coils is a member selected from the group consisting of a silicone, thermoplastic, and rubber material.

14. The hand grip of claim 13, wherein the disposed thermally and electrically conductive polymer coils includes raised portions in the substantially cylindrical inner core, with some portions of the thermally and electrically conductive polymer above an outer layer of the inner core.

15. The hand grip of claim 10, wherein the substantially cylindrical inner core composed of an electrically and thermally insulating material is a member selected from the group consisting of a thermoplastic material, silicone, and rubber.

16. The hand grip of claim 10, wherein the power source is disposed in the end cap.

* * * * *